US005826882A

United States Patent [19]

Ward

[11] Patent Number: 5,826,882

[45] Date of Patent: Oct. 27, 1998

[54] SLOT CABINET AND BASE UNIT THEREFOR

[75] Inventor: Daniel E. Ward, Boulder, Colo.

[73] Assignee: Vector Slot Machine Company, L.L.C., Boulder, Colo.

[21] Appl. No.: 745,690

[22] Filed: Nov. 12, 1996

[51] Int. Cl.[6] ..... A63F 9/00

[52] U.S. Cl. ..... 273/309; 273/143 R; 312/194; 312/265.5; 312/265.6; 312/287; 312/289; 312/290; 312/223.1; 312/351.2

[58] Field of Search ..... 463/46, 20, 12, 463/13; 273/309, 143 R, 138.1, 138.2; 312/194, 195, 196, 265.5, 265.6, 290, 287, 289, 223.2, 223.3, 223.6, 351.2

[56] References Cited

U.S. PATENT DOCUMENTS

| | | | |
|---|---|---|---|
| D. 130,113 | 10/1941 | Bechtol . | |
| D. 140,771 | 4/1945 | Meyer | D34/5 |
| D. 284,592 | 7/1986 | Drews et al. | D31/38 |
| D. 307,771 | 5/1990 | Cesaroni et al. | D21/38 |
| D. 349,133 | 7/1994 | Janssen | D21/38 |
| D. 349,524 | 8/1994 | Brettschneider | D21/38 |
| 5,010,995 | 4/1991 | Okada | 194/219 |
| 5,611,553 | 3/1997 | Schoeman et al. | 312/223.6 |

FOREIGN PATENT DOCUMENTS

| | | | |
|---|---|---|---|
| 3424594 | 1/1986 | Germany . | |
| 3802600 | 8/1989 | Germany | 273/138 R |
| 405161757 | 6/1993 | Japan | 273/309 |
| 5-208071 (A) | 8/1993 | Japan . | |
| 5-228255(A) | 9/1993 | Japan . | |
| 6-23136 (A) | 1/1994 | Japan . | |
| 6-7528 (A) | 1/1994 | Japan . | |
| 6-23132 A) | 2/1994 | Japan . | |
| 6-47163 (A) | 2/1994 | Japan . | |
| PCT/JP92/10705 | 7/1993 | WIPO . | |

OTHER PUBLICATIONS

Advanced Card Technology, "Slot Stands" advertizement, Casino Journal, vol. 8, No. 10, Oct. 1995, p. 5.

Slot Machines A Pictorial History of the First 100 Years by Marshall Fey, fourth edition, Liberty Belle Books, pp. 212, 213, 1994.

*Primary Examiner*—Benjamin H. Layno

*Attorney, Agent, or Firm*—Fields and Johnson, P.C.

[57] ABSTRACT

A slot cabinet and base unit of this invention are provided for maximizing the number of gaming machines within a given floor space. The invention minimizes required floor space by reducing the size of the gaming machine and also enabling a player to sit closer to the gaming machine. The slot cabinet has a narrowed profile which reduced its effective width. The slot cabinet further includes a rear member which complements another slot cabinet placed back-to-back, thus reducing the overall width of two slot cabinets placed back-to-back. The arrangement of the elements of the gaming machine placed within the slot cabinet helps to reduce the overall size of the slot cabinet. The base unit of this invention enables a player to sit closer to a slot cabinet mounted thereon. The base unit may be configured for receiving back-to-back slot cabinets thereon, or may be configured for receiving a single wall slot cabinet. The base unit and slot cabinet may both be modified to achieve weight reduction.

28 Claims, 11 Drawing Sheets

Fig. 11
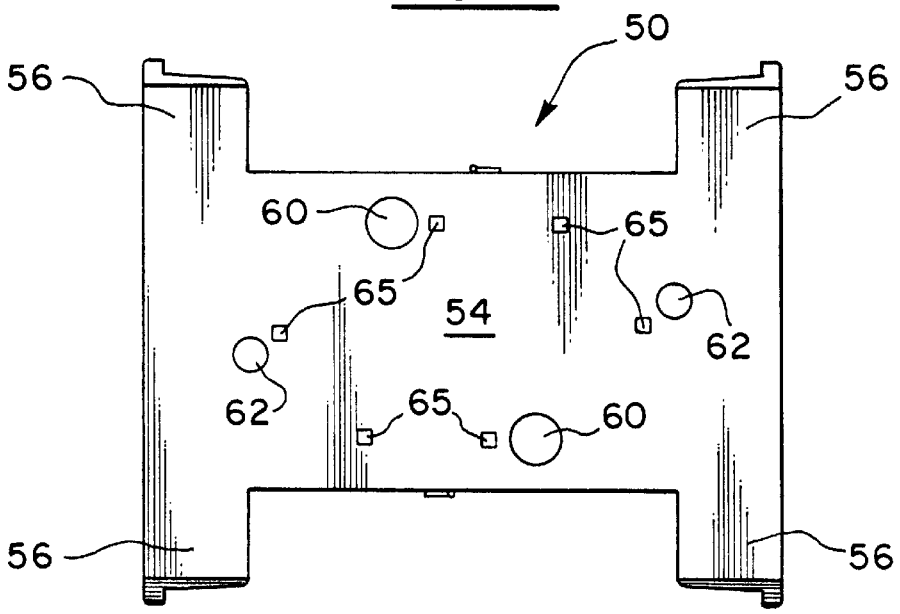
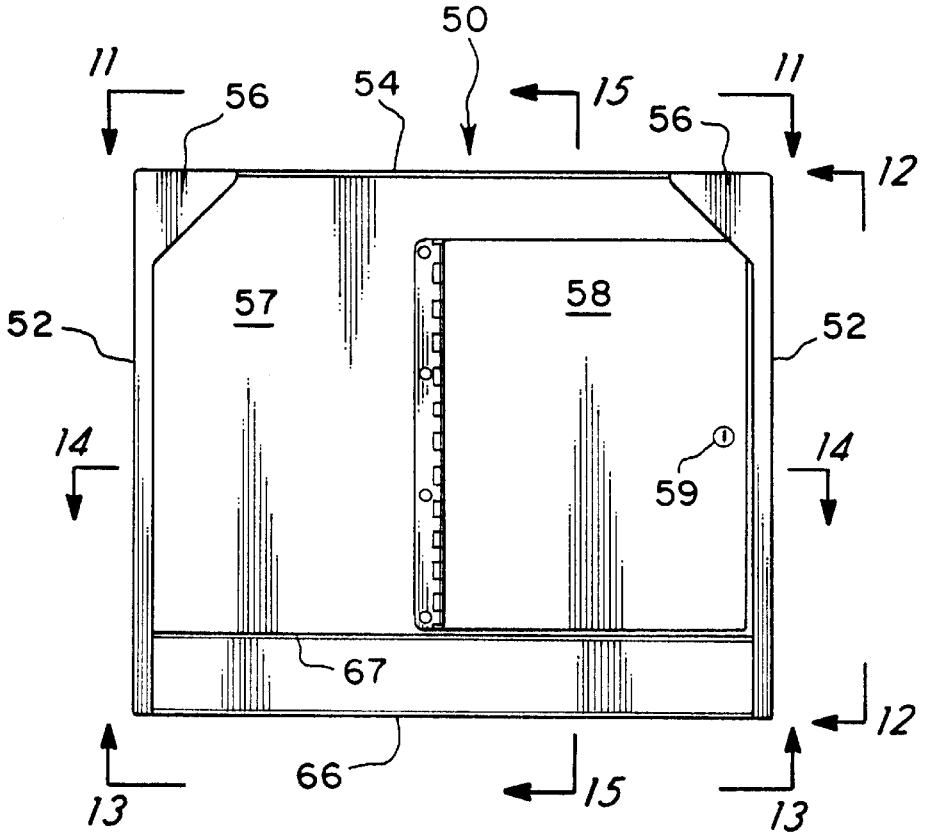
Fig. 10

Fig. 18
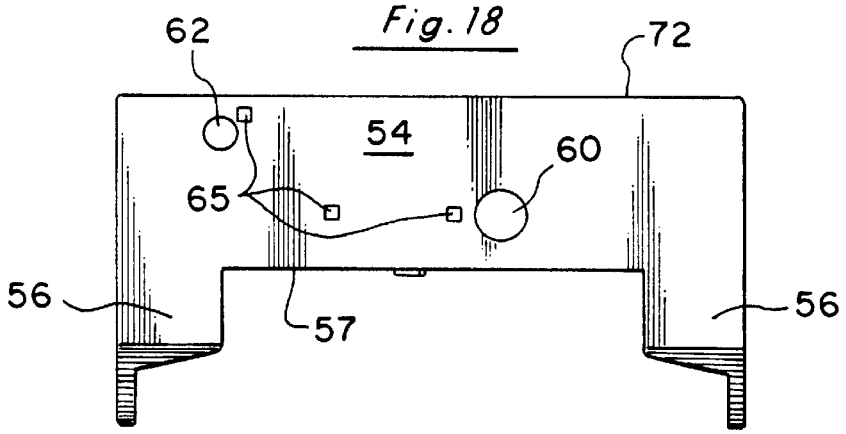
Fig. 17
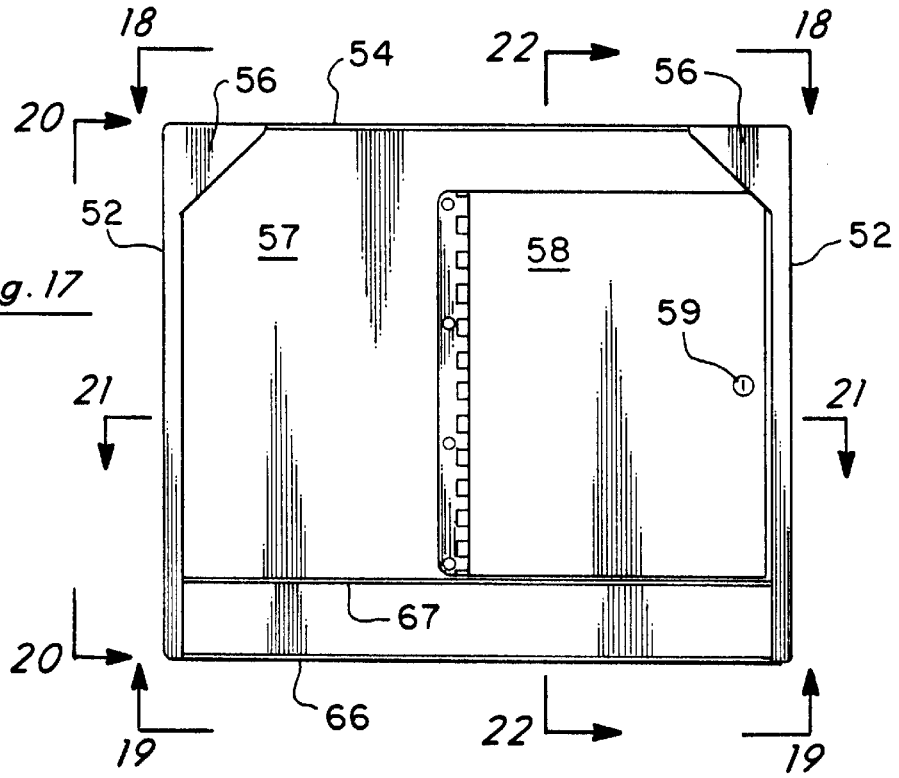
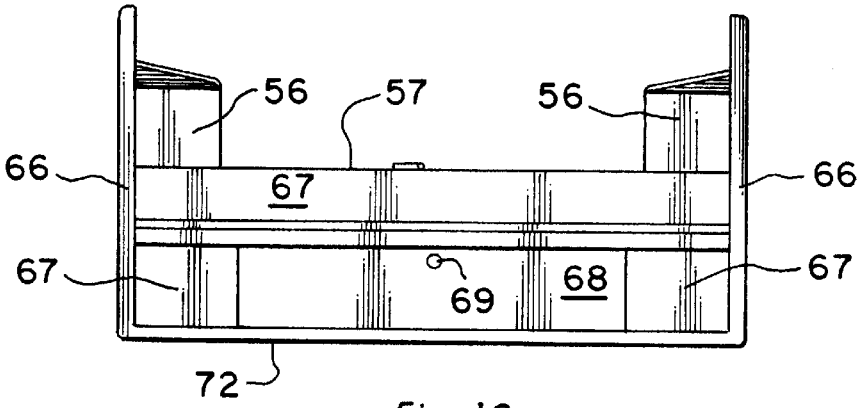
Fig. 19

75
77
78
77
56

74
56
65
75
54
59
52
56
58
58
79
56
57
65
52
75
77
51

55
55
53
55

SLOT CABINET AND BASE UNIT THEREFOR

TECHNICAL FIELD

This invention relates to an improvement in gaming machines, and more particularly, to an improved slot cabinet and base unit which maximizes the number of gaming machines which can be positioned in a given amount of floor space.

BACKGROUND ART

Gaming machines such as slot machines, automatic poker, or blackjack machines are commonly found in gambling casinos. The available floor space within the casino obviously dictates the number of gaming machines which may be placed in the casino. Casinos are often found in commercial or business districts where floor space is valued at a premium price. Furthermore, because of fire and safety regulations which require certain minimum aisle space through casinos, such regulations also limit the number of gaming machines which may be placed within a specified floor area. Although casino managers have become quite adept in arranging gaming machines to optimize the use of available floor space, one major limiting factor which determines the number of gaming machines that can be placed in a specified floor area is the individual size of each of the gaming machines. Another limiting factor is how close a player can comfortably sit to a gaming machine. Increasing the number of gaming machines in a casino results directly in additional game playing which, in turn, results directly in higher revenues for the gaming establishment.

For most gaming machines, such as slot machines, a lever or handle disposed on a side thereof requires a player to not only have space to view the gaming machine, but to also have space to the side of the machine in order to operate the lever to activate the machine. Accordingly, there must be a minimum spacing between gaming machines positioned side by side in order to allow the player to grasp the lever. Furthermore, as discussed above with respect to fire and safety regulations, there must be minimum spacing between rows of machines.

One factor which in the past has determined the size of each individual gaming machine is the arrangement of the component elements making up the particular machine. In prior art gaming machines, the circuitry, power supply and other related mechanical and electrical elements are co-located near the base of the gaming machine. Disposed thereabove at approximately chest level of the player is the gaming display, such as the rotatable reel displays in a slot machine. More specifically, the display on a slot machine is an annular row of symbols attached over a plurality of rotatable reels. The particular arrangement of the symbols in resulting transverse rows after the rotatable wheels have ceased turning determines whether the player has won. The arrangement of the electrical and mechanical elements concentrated near the base of the gaming machines has resulted in the cabinet housing the gaming machine being undesirably large.

Typically, multiple gaming machines are placed back-to-back and in a plurality of adjacent rows. Alternatively, the machines are arranged in a circular manner creating a gaming "island." Because of the size of the prior art gaming machines, wasted floor space is magnified when such gaming machines are placed in the "island" configurations or in the plurality of adjacent rows.

One example of a prior art gaming machine is disclosed in U.S. Pat. No. Des. 307,771 to Cesaroni, et al. This reference exemplifies typical prior art machines which lack individual compact size and the capability to be placed in a compact multiple configuration thus resulting in wasted floor space.

Another example of a prior art gaming machine is found in U.S. Pat. No. Des. 284,592 to Drews, et al. This reference illustrates a back-to-back arrangement of two gaming machines, which, like the Cesaroni reference, lacks certain characteristics which can thereby minimize the size of a multiple machine configuration. While the foregoing inventions may be suitable for their intended purposes, the invention disclosed herein provides distinct advantages as set forth below.

SUMMERY OF THE INVENTION

In accordance with this invention, a slot cabinet for housing a gaming machine and a base unit for supporting the gaming machine are provided. The slot cabinet and base unit of this invention are improvements over the prior art both in terms of reducing the size of a gaming machine, but also in reducing the amount of space required by a player to operate the gaming machine. The slot cabinet structure is characterized by a pair of spaced vertical side walls interconnected by a rear wall on one side and a plurality of partitions on the opposite side. The front side of the slot cabinet includes a plurality of openings which may accommodate the placement therein of desired elements of the gaming machine. In the preferred embodiment of the slot cabinet for housing elements of a slot machine, a first opening is provided for receiving the main circuit board of the slot machine and a second opening is provided for receiving the rotatable reels of the slot machine display. A bottom portion of the slot cabinet is sized to receive a coin hopper, power supply, a bill changer, and a lever assembly connecting to the lever arm of the slot machine. As will be further explained below, the unique shape of the slot cabinet and the arrangement of the slot machine elements within the cabinet results in the reduction in the overall size of the slot cabinet and allows a player to be positioned closer to the slot cabinet.

The rear wall of the slot cabinet has a unique configuration which enables it to be placed back-to-back with a complementing slot cabinet thus substantially reducing the back-to-back width of a pair of slot cabinets. In the preferred embodiment, the rear wall of the slot cabinet includes an extended portion and a receded portion, the extended portion of one slot cabinet being placed opposite the receded portion of the complementary slot cabinet. To accommodate the provision of an extended portion and receded portion, the main circuit board is placed at an angle within the slot cabinet.

The base unit of this invention is structurally characterized by a pair of spaced side walls interconnected by a facing or a recessed wall positioned perpendicularly thereto. The facing or recessed wall may include an access door for receiving a coin bucket which catches an overflow of coins from the coin hopper. The recessed wall is offset with respect to the side walls resulting in the creation of opposing flanges which project from the recessed wall. The base unit further includes an upper surface for receiving the slot cabinet thereon. The upper surface has a plurality of openings or holes to receive electric wiring from the slot machine and to receive the discharge of excess coins which overflow the capacity of the coin hopper. A bottom member residing above the level of the floor attaches to the facing or recessed wall and side walls. The space between the bottom member and the floor creates a foot relief for a player sitting at the gaming machine. An opening may be formed in the bottom member and a trap door placed thereover in order to provide direct access to electrical power or control lines which may be positioned on or underneath the floor and which communicate with each of the gaming machines. When the base unit is configured to receive two slot cabinets placed back-to-back thereon, the base unit is more specifically defined as a dual base unit which includes two pairs of flanges and two opposing recessed walls with corresponding access doors. A divider is placed within the opening created by the side walls and front or recessed walls, thus dividing the opening into two identical modules so that coin buckets or the like may be placed therein corresponding to the gaming machine positioned thereabove.

If a single gaming machine is to be placed against a wall, then the corresponding base unit is more specifically defined as a wall base unit which includes a flat rear wall and a single facing or recessed wall positioned between the side walls.

In addition to the space saving advantages of the slot cabinet and base unit of this invention, it may also be desirable to minimize the weight of the slot cabinet and base unit. According to another preferred embodiment of the base unit of this invention, a modified dual or wall base unit may be provided which is advantageous for minimizing weight in locations such casinos on gambling ships. The side walls and upper surface of the modified base unit may include removable panels. If, for example, the base unit in question is placed on the left end of a row of base units, a removable panel may be placed on the exposed left side wall. However, the non-exposed right side wall may have the panel removed to reduce the weight of the base unit. If the base unit in question is placed interiorly within a row of base units, then both the left and right side walls may remain open by removing the corresponding removable panel.

The gaming regulations of many jurisdictions require that each gaming machine be isolated from all other gaming machines. Accordingly, the divider placed within the base unit and the side walls must still be present in some form which effectively isolates each gaming machine. According to the modified base unit, the divider and side wall inserts may each be made of a perforated sheet of lightweight metal such as nickel or aluminum. Thus, these types of dividers and side wall inserts still comply with regulations, but further reduce the overall weight of the base unit.

As with the base unit, the slot cabinet may also be modified to reduce its weight. For example, the plurality of partitions may be made of the same type of perforated member as the divider in the modified base unit. Additionally, the bottom of the slot cabinet or any other surface which is not exposed may be made of a similar type of perforated material. Even the frame member surrounding the power supply could be made of this reduced weight perforated material in order to reduce the overall weight of the gaming machine.

Further advantages of this invention will become apparent from the description which follows taken in conjunction with the accompanying drawings.

BRIEF DESCRIPTION OF THE DRAWINGS

FIG. 10 is a front elevation view of the dual base unit of this invention;

FIG. 11 is a top view of the dual base unit of this invention;

FIG. 17 is a front elevation view of the wall base unit;

FIG. 18 is a top view of the wall base unit;

FIG. 19 is a bottom view of the wall base unit;

BEST MODE FOR CARRYING OUT THE INVENTION

Figure 1:
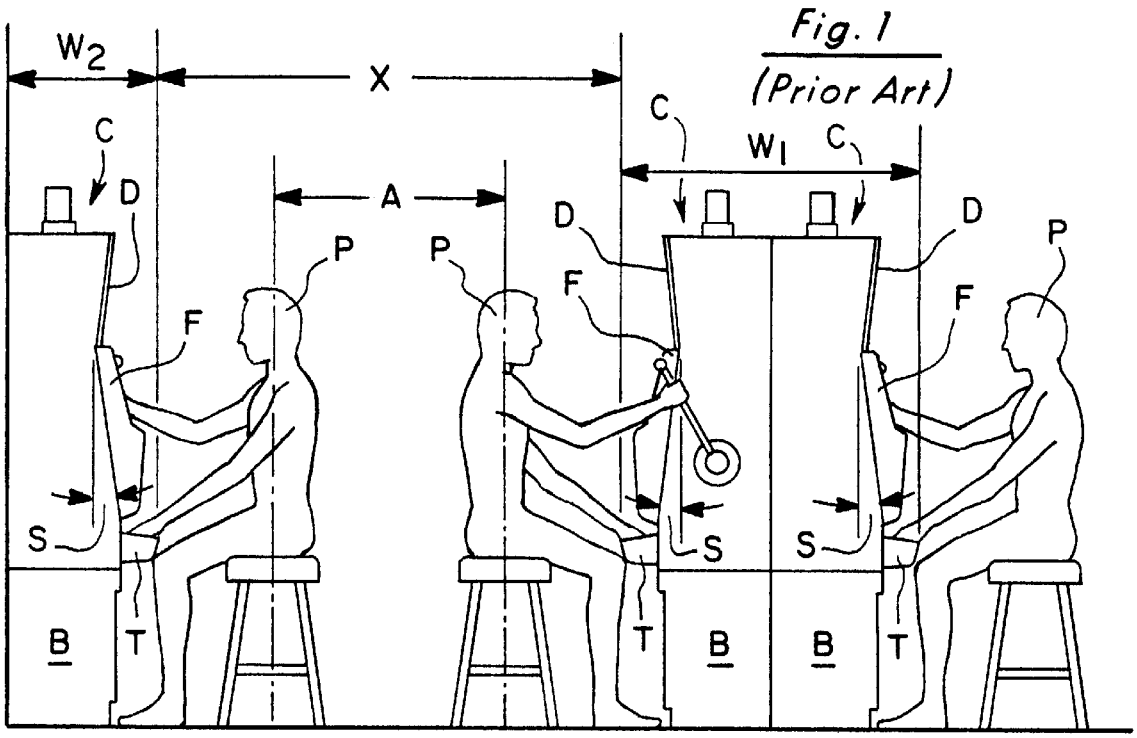
Fig. 1 (Prior Art)
FIG. 1 is a side elevation view of prior art gaming machines arranged on a given floor space.

As shown in FIG. 1, prior art gaming machines can be provided as single units against a wall, or can be arranged back-to-back. A gaming machine may comprise a slot cabinet C including a payoff display board D and face plate F mounted on the front side of the gaming machine. A player P is positioned in front of each of the gaming machines. Each of the cabinets C are mounted upon a base B which elevates the cabinet above the ground. The coin tray T extends at or below the knee level of the player P. The back-to-back width of two cabinets is shown as $W_1$. The width of a single wall cabinet is shown as $W_2$. The total distance between rows of gaming machines is illustrated as distance X. The aisle width for walking between rows of gaming machines is illustrated as distance A, indicating the centerline distance between players who are positioned in front of opposing gaming machines. The faceplate F is mounted on the cabinet C as shown a slant angle S.

Figure 2:
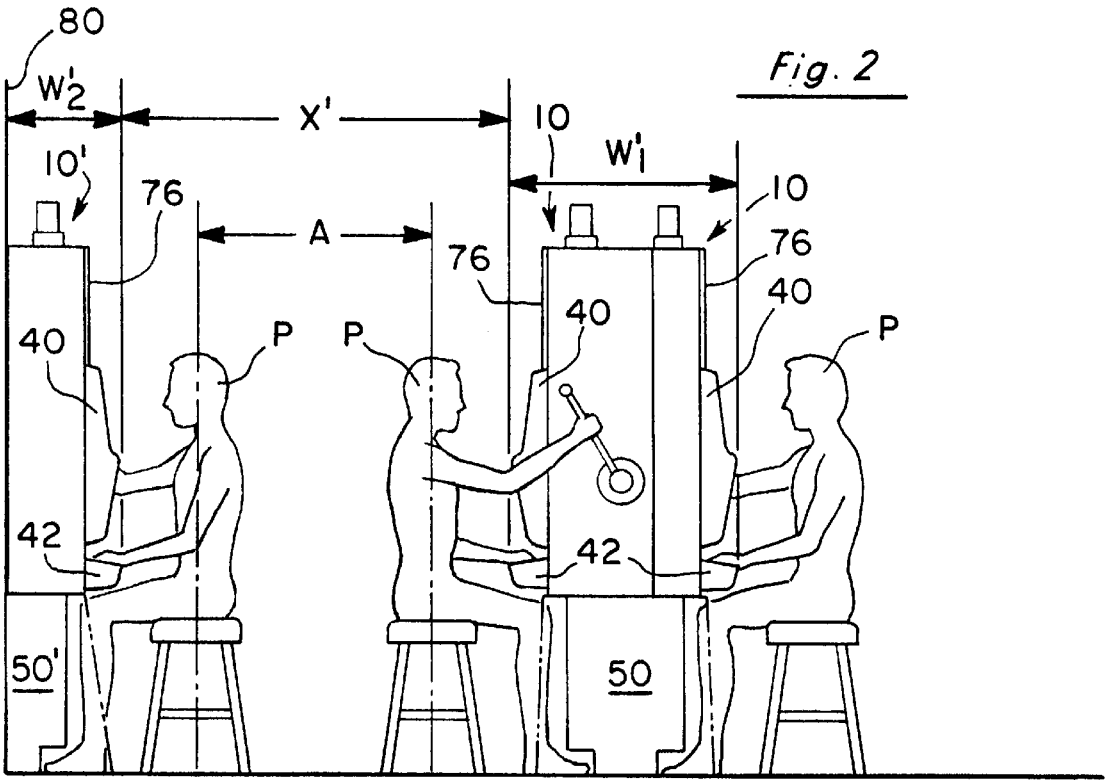
FIG. 2 is a side elevation view of the slot cabinet and base unit of this invention incorporating gaming machines therein and arranged on the same floor space.
Figure 3:
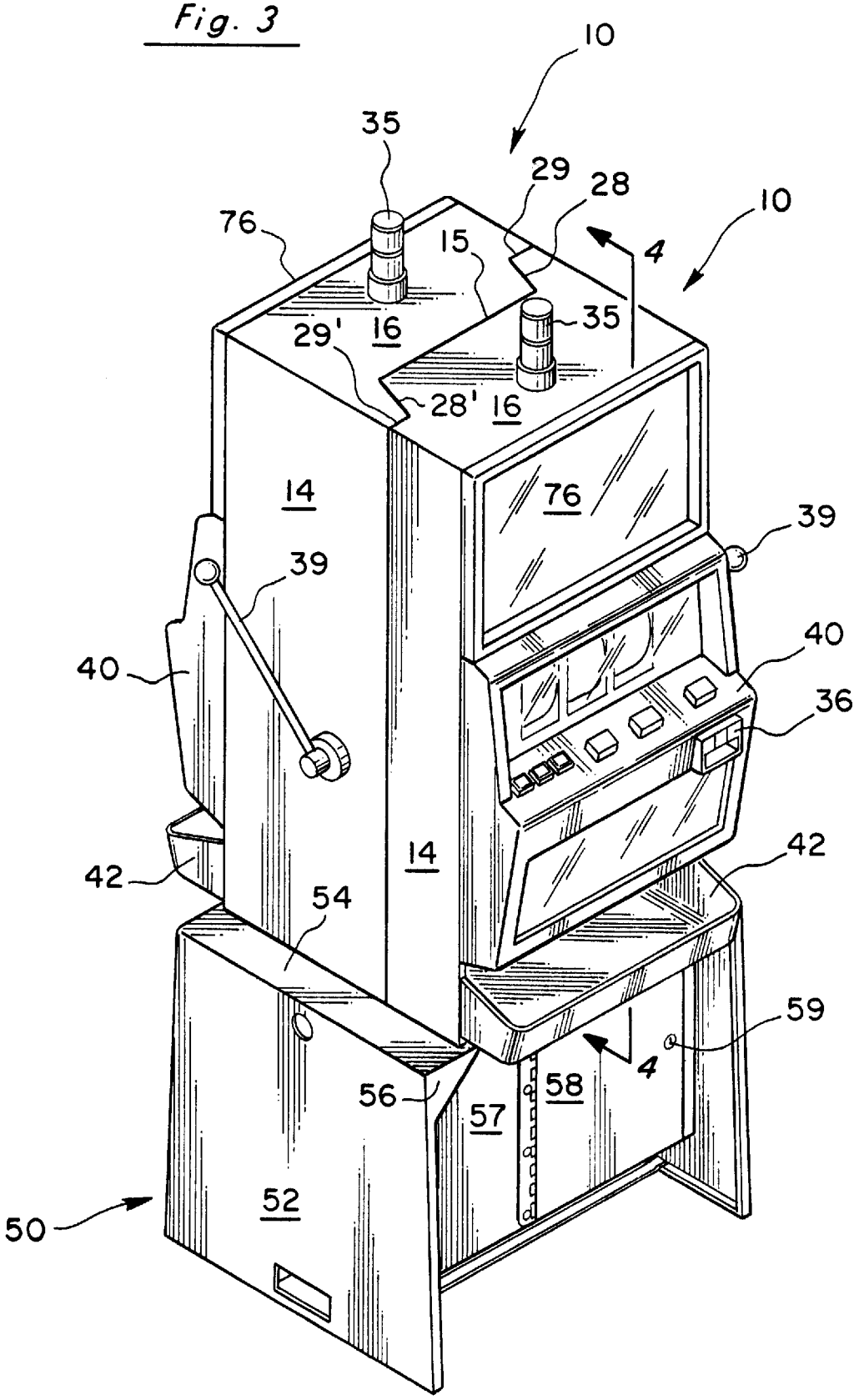
FIG. 3 is a perspective view of two back-to-back slot cabinets mounted on a dual base unit of this invention.

As illustrated in FIG. 2, and as further discussed below, incorporating the use of the slot cabinet and base unit of this invention results in maximization of available floor space in a gaming casino. Each of the distances indicated in FIG. 1 can be substantially reduced, as shown in FIG. 2, by the use of the slot cabinet and base unit of this invention. More specifically, the same aisle distance A can be maintained, but the back-to-back width of two cabinets is reduced to $W'_1$, the width of a single wall cabinet is reduced to $W'_2$, and the total distance between rows of gaming machines is reduced to X'. FIG. 2 shows back-to-back slot cabinets 10 mounted on a dual base unit 50. Adjacent the back-to-back slot cabinets is positioned a wall slot cabinet 10' mounted against the wall 80.

As illustrated in FIGS. 3–7, the slot cabinet of this invention 10 in its simplest form comprises a pair of opposed side walls 14 interconnected by a rear member 12 on one end of the side walls, and interconnected at the other end of the side walls as by upper divider 20 and inclined lower divider 22.

Figures 4, 5, 6, 7, 8:
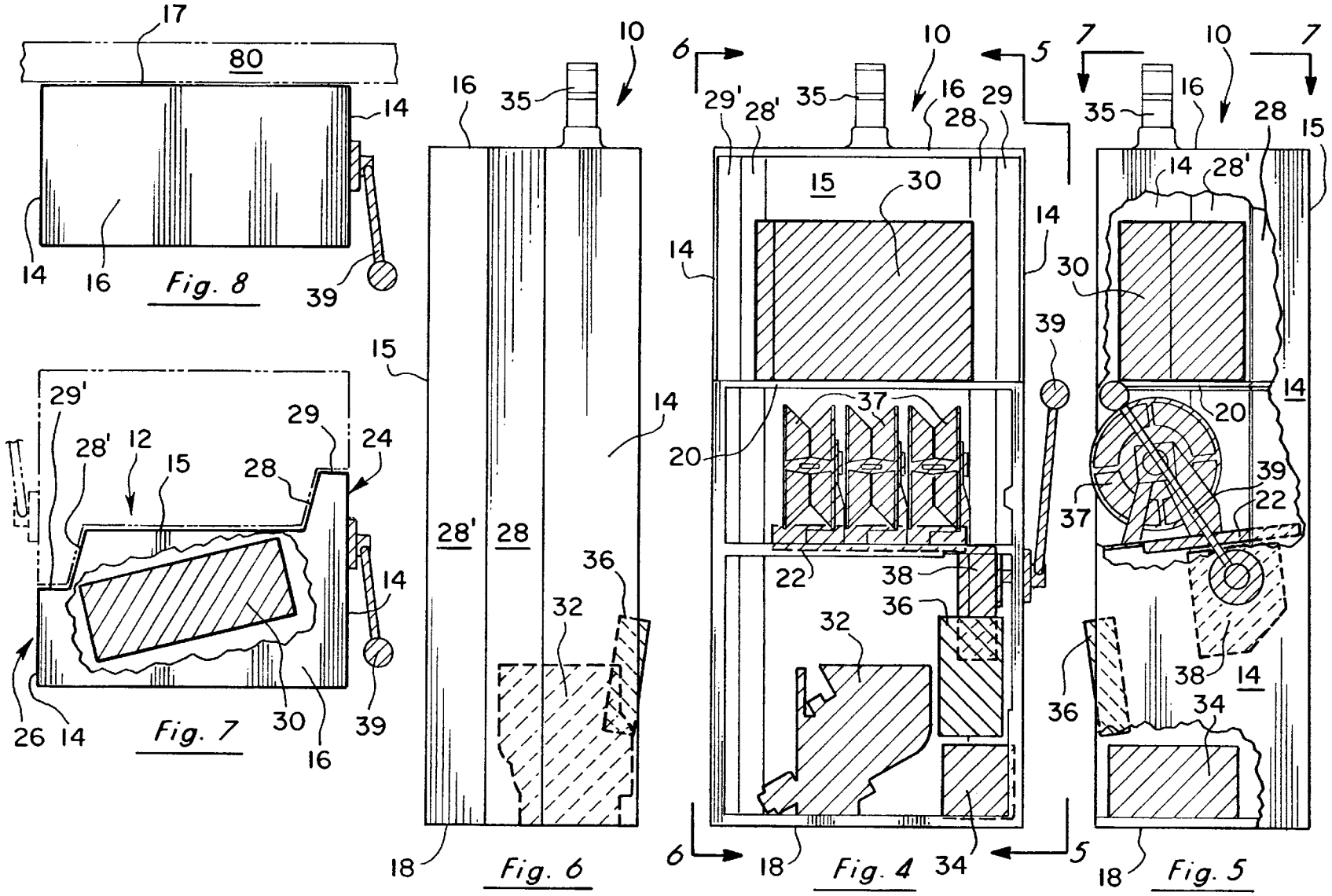
FIG. 4 is a front vertical section, taken along line 4—4 of FIG. 3, illustrating the internal arrangement of component elements of a slot machine placed within the slot cabinet of this invention.
FIG. 5 is a fragmentary right side elevation view of the slot cabinet of this invention taken along line 5—5 of FIG. 4, also illustrating the arrangement of the slot machine elements therein.
FIG. 6 is a left side elevation view taken along line 6—6 of FIG. 4, of the slot cabinet of this invention.
FIG. 7 is a fragmentary top view of back-to-back slot cabinets of this invention.
FIG. 8 is a top view of a single slot cabinet of this invention configured for placement against a wall.

In order for the slot cabinets to be placed in a space saving back-to-back arrangement, rear member 12 includes rear surface 15, an extended portion 24, and a receded portion 26 each connected at opposite ends of the rear surface 15. The extended portion 24 houses the structural components of lever assembly 38, while the receded portion 26 accommodates a complementary extended portion from another slot cabinet placed back-to-back thereto. Extended portion 24 may be defined by a slanted projection 28 and a flat 29 which intersects with side wall 14. Similarly, receded portion 26 may be defined by a reverse slanted notch 28' and corresponding flat 29'. The upper and lower surfaces of the slot cabinet are defined by top surface 16 and bottom surface 18, respectively. As shown in FIG. 8, the slot cabinet may be configured for mounting against a wall 80. Accordingly, rear member 12 of wall base unit 10' may simply comprise flat rear wall 17.

The open space formed between top surface 16 and upper divider 20 generally defines a first opening. The open space formed between upper divider 20 and inclined lower divider 22 generally defines a second opening.

When the slot cabinet of this invention is used to house elements of a slot machine, the main circuit board 30 may be placed upon upper divider 20. Directly below the main circuit board 30 may be placed the rotatable reels 37, which are mounted upon inclined lower divider 22. An annular row of symbols (not shown) are attached over a corresponding reel. Mounted on the bottom surface of the slot cabinet is coin hopper 32 and power supply 34. The coin hopper 32 is used for retaining coins which are placed into a machine by a player. The coin hopper serves as the reservoir to either dispense coins when a player wins, or to retain coins when the player does not win. If the coin hopper becomes full, it may dispense coins downwardly through a coin chute (not shown) and into a coin bucket placed within a module of the dual base unit 50, as further discussed below. Power supply 34 generates the appropriate voltage and current required by the main circuit board and other elements within the slot machine to operate the slot machine. Lever assembly 38 is positioned on the right side of the slot cabinet 10 and elevated above the bottom surface 18 at a predetermined height. Lever assembly 38 includes lever arm 39 that is pulled by a player. Mounted to the top surface 16 is the alarm unit 35 which may indicate a malfunctioning slot machine or the winning of a jackpot. Optionally, a bill changer 36 may be added to the slot cabinet by positioning the bill changer 36 above the power supply 34. As shown in FIG. 7, to accommodate the reduced profile of the slot cabinet, the circuit board 30 is mounted at an angle within the slot cabinet.

The slot machine elements incorporated within the slot cabinet of this invention are illustrated with cross-hatched lines. It will be understood that these cross-hatched lines do not represent a cross-sectional view of these elements, but such cross-hatching is provided only to highlight the spacial arrangement of the slot machine elements within the slot cabinet.

In the prior art, the main circuit board 30 was typically placed at or near the bottom surface 18. Available space within the slot cabinet is maximized by positioning the main circuit board 30 on upper divider 20. The size of coin hopper 32 according to this invention has been substantially reduced, along with the size of power supply 34. The reduction in size of these two units also results in maximization of available space within the slot cabinet. By moving the main circuit board 30 away from the bottom surface 18 and by reducing the size of the coin hopper 32 and power supply 34, the overall width, depth and length of the slot cabinet may be reduced.

When the elements of the slot machine are fully assembled, the slot cabinet appears as illustrated in FIG. 2. As shown, payoff display 76 is mounted directly over the first opening. Face plate 40 is mounted over the second opening. Payoff display 76 and face plate 40 are both mounted in a vertical fashion to the cabinet in order to reduce the overall profile of the slot cabinet. Coin tray 42 is positioned directly below the faceplate 40, and raised to a height so that a player's knees may be positioned thereunder.

Figure 9:
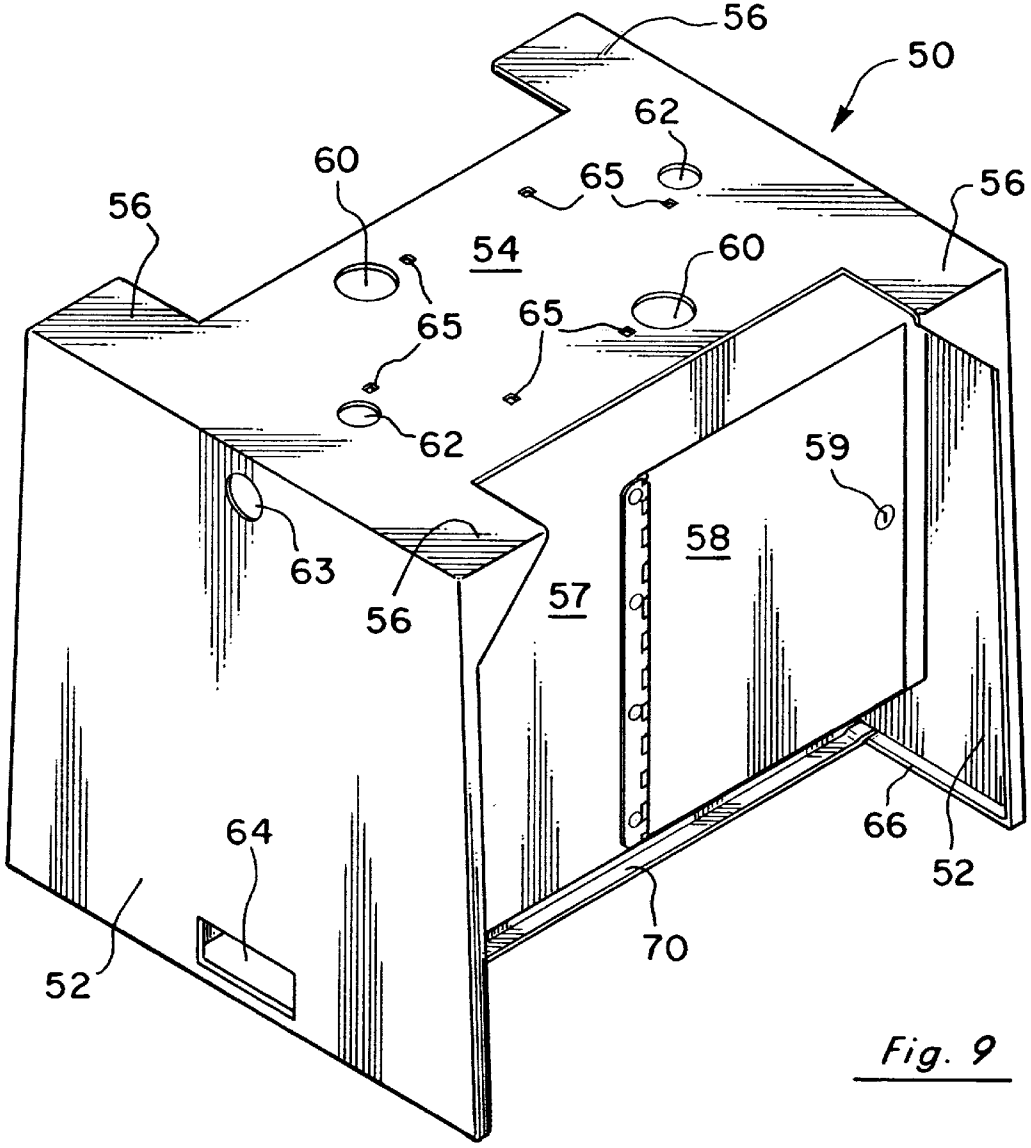
FIG. 9 is a perspective view of dual base unit of this invention.
Figure 12:
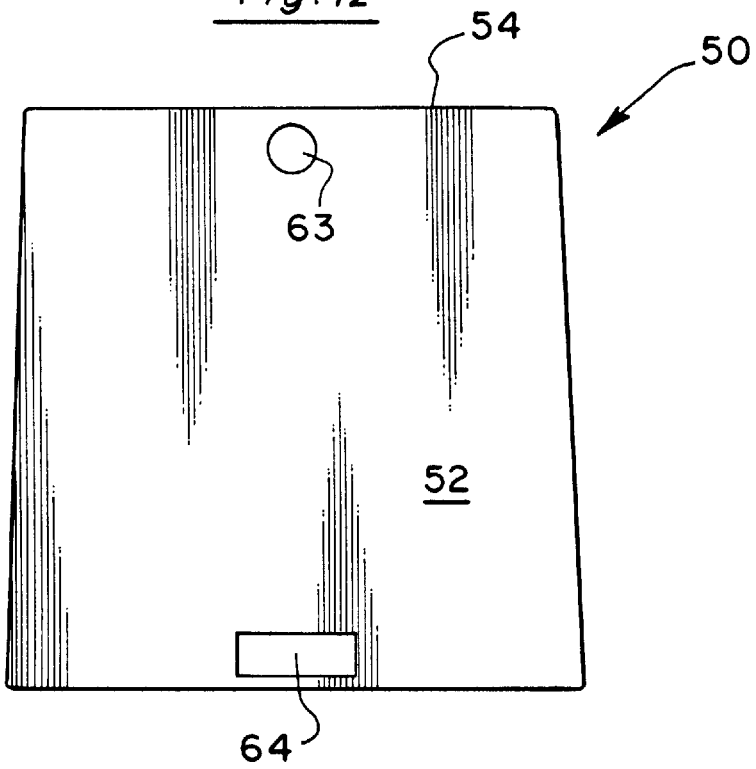
FIG. 12 is a left or right side elevation view of the dual base unit of this invention.

As shown in FIG. 9, a dual base unit 50 is provided for supporting a pair of back-to-back arranged slot cabinets. The structure of the dual base unit 50 is most simply described as including a pair of opposing side walls 52 interconnected by a pair of facing or recessed walls 57. Although the figures illustrate walls 57 to be recessed with respect to walls 52, it will be understood that facing walls can be positioned flush with respect to walls 52 so that there is not an identifiable recess. An upper surface 54 extends between the side walls and recessed walls, providing a stable surface for mounting the slot cabinets. Recessed walls 57 are receded within the exterior edges of side walls 52. Upper surface 54 extends continuously to the exterior edges of side walls 52 thus forming flanges 56. Each facing or recessed wall 57 may include an opening for mounting a corresponding access door 58. Access door 58 may be hinged as shown, or may be attached by other methods well-known in the art. A lock unit 59 can be used to secure access door 58. Two modules may be formed within the dual base unit 50 by placement of a divider 71 which traverses between opposing recessed walls 57. Divider 71 effectively isolates internal access from one gaming machine placed back-to-back with another gaming machine.

Upper surface 54 may include a plurality of holes or openings. For example, a pair of coin openings 60 can be provided which communicate with the coin chute (not shown) of the slot machine, the coin chute enabling excess coins to be transferred to a coin bucket (not shown) which is placed inside each module of dual base unit 50. Furthermore, dual base unit 50 may include a plurality of openings, such as openings 62, 63, and 64, for accommodating the passage of electrical lines or other wiring which control the slot machine. As shown in FIG. 9, electrical openings 62 are provided on upper surface 54 while openings 63 and 64 are positioned at upper and lower ends of side wall 52, respectively. Bolt holes 65 are also provided on upper surface 54 so that the slot cabinets may be securely mounted thereon.

Figure 13:
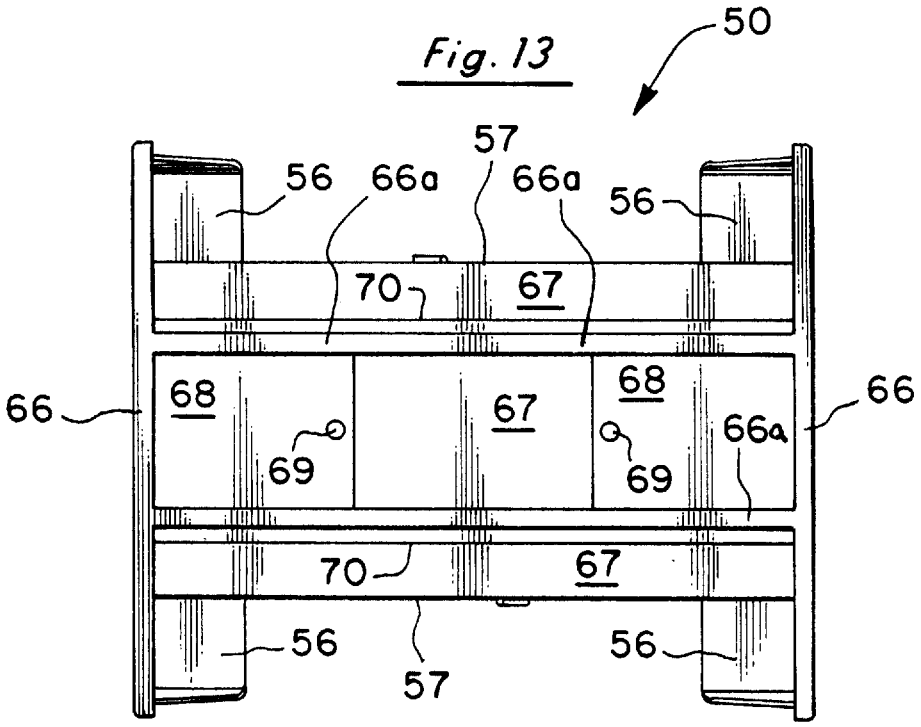
FIG. 13 is a bottom view of the dual base unit of this invention.

As best seen in FIGS. 9 and 13, the lower ends of side walls 52 include leg members 66 which may simply be in the form of a continuous flange or other horizontally extending member to help stabilize the dual base unit 50. Furthermore, as shown in FIG. 13, leg member 66 may also include a pair of spaced support members 66*a* which traverse bottom member 67 in a direction perpendicular to leg member 66.

Figure 14:
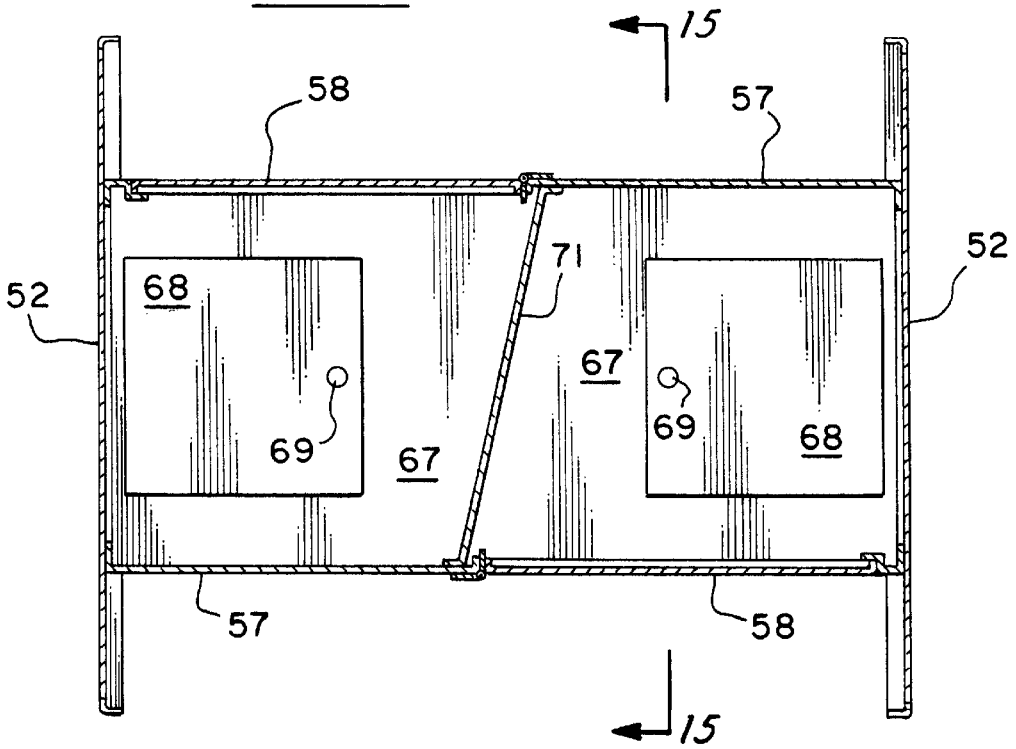
FIG. 14 is a horizontal section, taken along line 14—14 of FIG. 10, illustrating some of the interior details of the dual base unit.
Figure 15:
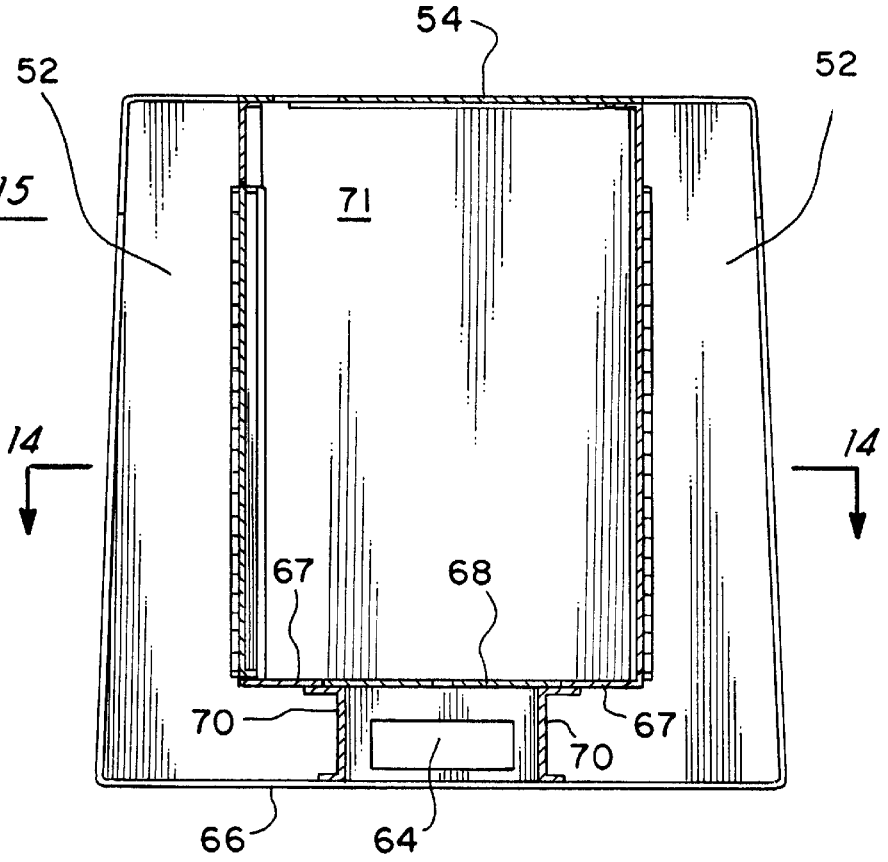
FIG. 15 is a vertical section, taken along line 15—15 of FIG. 10, further illustrating some of the interior details of the dual base unit.
Figure 16:
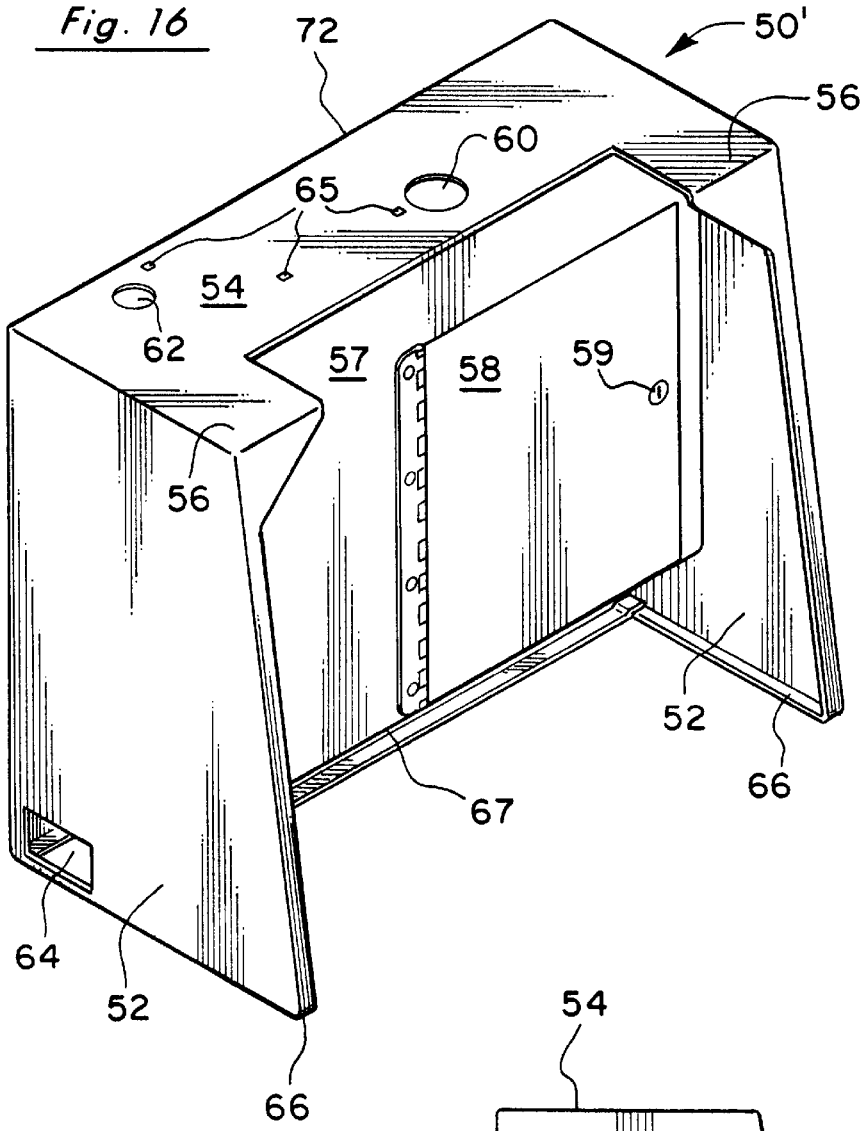
FIG. 16 is a perspective view of a wall base unit of this invention.
Figure 20:
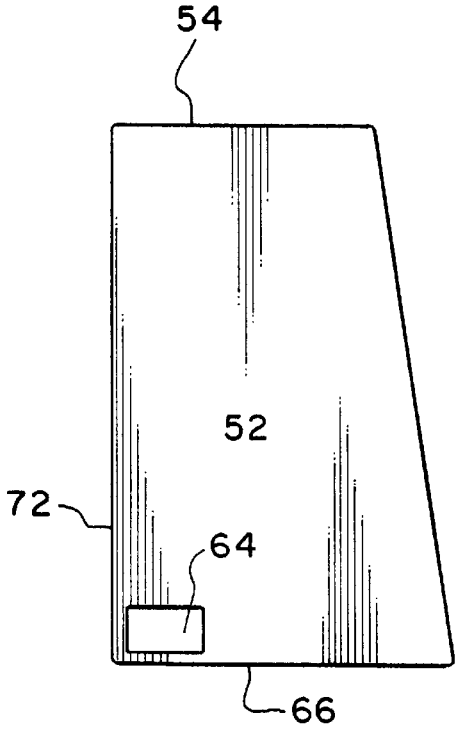
FIG. 20 is a left or right side elevation view of the wall base unit.
Figure 21:
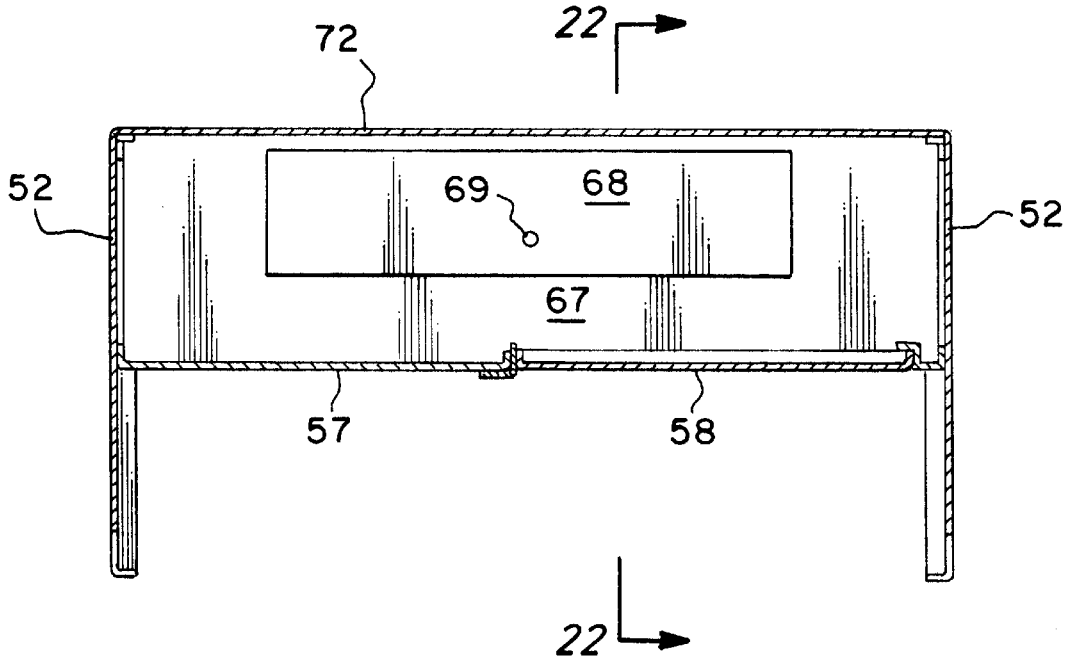
FIG. 21 is a horizontal section, taken along line 21—21 of FIG. 17, illustrating some of the interior details of the wall base unit.
Figure 22:
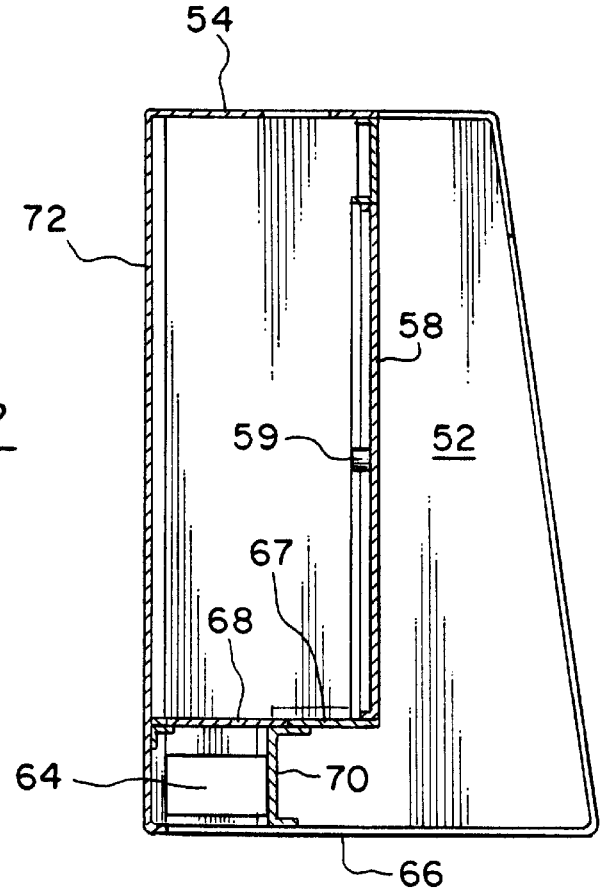
FIG. 22 is a vertical section, taken along line 22—22 of FIG. 17, illustrating some of the interior details of the wall base unit.

As shown in FIGS. 14 and 15, bottom 67 is continuous between side walls 52 and is delimited by both side walls 52 and facing or recessed walls 57. An opening may be formed in bottom 67 to accommodate the installation of a trap door 68. When the base unit of this invention is configured as a dual base unit for supporting a pair of back-to-back slot cabinets, a pair of openings may be formed on bottom member 67 to accommodate the installation of a two trap doors. As shown in FIG. 15, trap door 68 overhangs the opening formed through bottom member 67. Conveniently, a finger hole 69 may be drilled through trap door 68 to enable the trap door to be opened. Trap door 68 is provided to enable access to the floor underneath the base unit. Typically, electrical power wires or the like may be installed on or underneath the floor. Accordingly, if a maintenance technician requires access to the electrical power wires located beneath the base unit, the technician would simply open access door 58, remove the coin bucket therein, then open trap door 68.

As best seen in FIG. 15, bottom member 67 is supported above the ground by means of a pair of channel members 70 which are positioned below bottom member 67 and overlap the interface between trap door 68 and bottom member 67. Thus, as shown in FIGS. 9-15, a dual base unit may be provided to support a pair of back-to-back slot cabinets thereon, the dual base unit providing individual access doors and trap doors corresponding to the individual slot cabinet positioned thereabove.

As best seen in FIGS. 2 and 15, the portion of bottom member 67 which overhangs channel 70 enables the foot F of a player P to be positioned within the space therebelow. This foot relief alone or along with the offset positioning of recessed wall 57 enables a player to sit closer to the slot cabinet.

FIGS. 2 and 16–22 illustrate a single base unit 50' of this invention. The single base unit 50' is used in conjunction with a single slot cabinet 10' which is positioned against the wall 80. The construction of single base unit 50' is identical to dual base unit 50 in that single base unit 50' represents only one-half of the dual base unit 50. Accordingly, a flat rear wall 72 is provided for placement against the wall 80 in lieu of an opposing recessed wall. The single base unit 50' also includes a single access door 58 and a trap door 68.

Figures 23A, 23B:
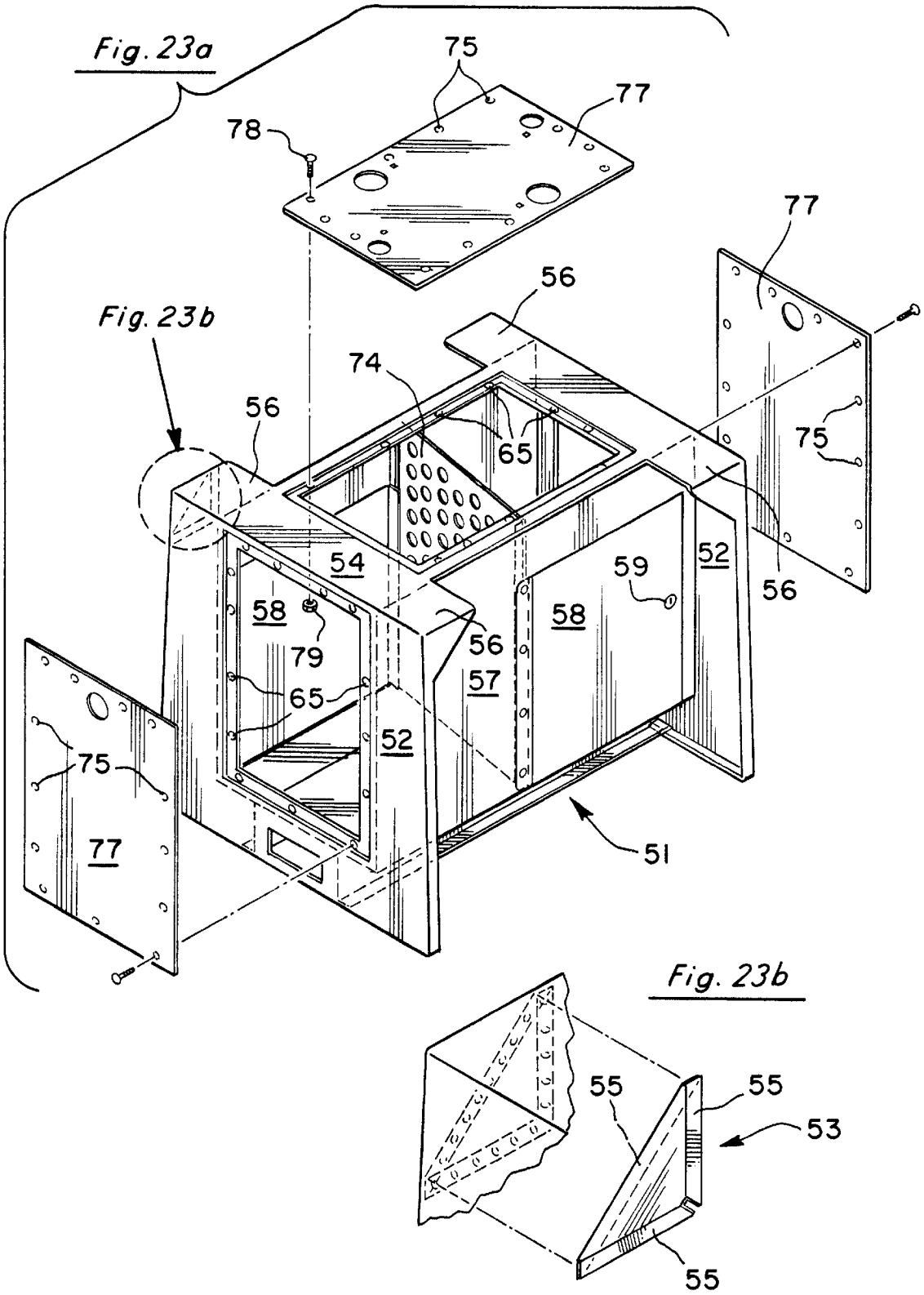
FIG. 23*a* is an exploded perspective view of a modified dual base unit.
FIG. 23*b* is an enlarged exploded view of a gusset member used on the dual base unit of FIG. 23*a*.

As shown in FIG. 23, a modified base unit 51 is provided which is much lighter in construction than dual base unit 50 or single base unit 50'. Reduction in weight is achieved by eliminating large portions of side walls 52 and upper surface 54. Accordingly, large openings are formed therethrough which may be covered by removable panels 77, as shown. For example, if modified base unit 51 as shown in FIG. 23 is used as the right-most base unit in a row of base units having corresponding slot cabinets mounted thereon, then modified base unit 51 would remain without panels covering the left side wall and the upper surface 54. However, one removable panel 77 could be placed to cover the opening on the right side wall 52. Removable panel 77 may be attached to the modified base unit as is well-known in the art, for example, by bolts, screws, or other removable locking means. As shown, panels 77 may include a plurality of bolt holes 75 which align with holes 65 of the modified base unit 51. Then, a plurality of nuts 79 and bolts 78 can secure the panels 77 to the base unit 51. Since a major part of upper surface 54 has been eliminated, the back-to-back slot cabinets mounted on the modified base unit would be attached to the base unit on its periphery, as marked by bolt holes 65. Depending upon the exact type of gaming machine that is to be placed upon modified base unit 51, the thickness and length of the remaining portions of upper surface 54 can be altered to accommodate proper attachment of the gaming machine thereon.

In addition to the removal of portions of side walls 52 and upper surface 54, divider 71 can be modified to provide the necessary privacy of a module formed by the partition, and also to provide a reduction in overall weight of a base unit. Accordingly, a perforated divider 74 can be provided which is in the form of a member which includes a plurality of openings or holes to reduce the weight thereof. Furthermore, divider 74 can be made of a particularly lightweight material such as nickel or aluminum.

As discussed above, many jurisdictions have regulations which require the complete isolation of each gaming machine. The removable panels 77 can be replaced with side wall inserts (not shown) of the same size and shape, the side wall inserts being made of the same material as perforated divider 74. Therefore, in those regulated jurisdictions, perforated divider 74 and the side wall inserts are acceptable substitutes. As also shown in FIG. 23, a gusset member 53 may be provided to increase the strength of the modified base unit 51. Gusset member 53 includes edges 55 which may conform to the particular surface on which the edges are attached.

As with the modified base unit 51, the structural members of the slot cabinet may also be modified to reduce its weight. For example, upper partition 20, lower incline divider 22, and bottom member 18 may be made of material similar to perforated divider 74. Ultimately, any non-exposed member of the slot cabinet may be made of material similar to perforated divider 74 in order to reduce the weight of the slot cabinet.

By the foregoing, the advantages of the slot cabinet and base unit of this invention are apparent. The unique shape of the slot cabinet enables it to be made a minimum size which in turn minimizes the amount of space needed to install the slot cabinets in a gaming casino. For placement of gaming machines in a back-to-back configuration, the rear member of the slot cabinet is adapted to minimize the separation between the slot cabinets. The substantially vertical front side of the slot cabinet enables the payoff display 76 and face plate 40 to be mounted in a vertical fashion, as opposed to the prior art which mounted both the face plate and payoff display at angles. The elimination of these angles narrows the profile of the slot cabinet.

By placing the main circuit board of the slot machine in the available space behind the payoff display, the overall size of the slot cabinet can be reduced. By reducing the size of other component elements, such as the coin hopper and power supply, the slot cabinet can be further reduced in size.

Additionally, the mounting of the main circuit board at an angle within the slot cabinet accommodates the rear member 12 which may have an irregular shape. Although FIG. 7 illustrates rear member 12 as including an extended portion 24 and receded portion 26, it will be understood by those skilled in the art that the slot cabinet when viewed from above may be more of a triangular shape. In either case, one side wall of the slot cabinet will be longer than an opposing side wall which enables two slot cabinets to be placed back-to-back without unduly increasing the overall width of the back-to-back arrangement.

By incorporating a vertical interface on the front side of the slot cabinet for attaching the slot machine elements thereto such as the face plate, the projection of those elements is greatly reduced. In normal slot machines, the front side of the slot cabinet projects approximately 18" away from the main body of the slot cabinet primarily because of the slanted mounting of the face plate. According to the present invention, the projection is reduced to around 10", which is the depth of a standard slot machine face plate mounted in a vertical fashion.

The arrangement of the elements of the slot cabinet and base unit allow the player to sit closer to the slot cabinet which again reduces the amount of floor space required. Since the coin tray 42 is raised above the level of the player's knees, the player can be positioned closer to the slot cabinet. The incorporation of a recessed wall and overhanging bottom member enables a player to sit closer to the slot cabinet and to place legs and feet in a more normal sitting position.

Although the base unit of this invention has been illustrated for use with the slot cabinet of this invention, it will be understood by those skilled in the art that the depth of the base unit may be increased to accommodate the placement of a pair of back-to-back prior art slot machines thereon. Accordingly, even with the placement of prior art slot machines upon the base unit of this invention, floor space within a gaming casino can be maximized because the base unit by itself provides a saving in space by enabling a player's knees and feet to be placed closer to the gaming machine.

A round carousel of eight conventional prior art slot machines takes up approximately 48.6 square feet of floor space. A carousel of eight slot cabinets and base units of this invention occupies only 24.1 square feet. Consequently, a gaming establishment can make better use of available floor space and increase its revenues with very little additional capital outlay.

Although the slot cabinet of this invention has been described particularly for use with elements comprising a slot machine, it will be understood that the slot cabinet of this invention may be used in other applications, such as video arcade machines, or other gaming machines such as automated blackjack and poker machines.

Additionally, since only the front of the slot cabinet is viewed by a player, the need for expensive decorative lamination or other decorations on the sides of the slot cabinet is eliminated.

The base unit and slot cabinet of this invention have been described with reference to particular embodiments thereof; however, it will be understood that modifications can be made which fall within the spirit and scope of this invention.

What is claimed is:

1. A base unit for mounting a slot machine thereon, said base unit comprising:

a first pair of spaced opposed walls;

a second pair of spaced opposed walls interconnecting said first pair of spaced opposed walls and arranged substantially perpendicular thereto, said first and second pairs of spaced opposed walls forming a central opening therebetween;

at least one pair of flanges extending from corresponding ends of said second pair of apposed walls;

a bottom member interconnecting said first and second pairs of spaced opposed walls, said bottom member including at least one bottom opening formed therethrough; and a trap door mounted to said bottom member and covering said bottom opening.

2. A base unit, as claimed in claim 1, further including:

an upper surface attached to said first and second pairs of spaced opposed walls, said upper surface including a plurality of upper openings formed throughout.

3. A base unit, as claimed in claim 1, further including:

an access door mounted to one wall of said second pair of space apposed walls.

4. A base unit, as claimed in claim 1, further including:

a divider placed within said central opening for creating at least two modules therein.

5. a base unit, as claimed in claim 4, wherein:

said divider is perforated.

6. A base unit, as claimed in claim 1, wherein:

said first pair of spaced opposed walls include at least one removable panel.

7. A base unit, as claimed in claim 6, wherein said at least one removable panel includes:

a plurality of holes formed therethrough to reduce the weight of said at least one removable panel.

8. A base unit, as claimed in claim 1, further including:

at least one channel connected to said bottom member for supporting said bottom member above the surface of the ground, said at least one channel being positioned interiorly of said first pair of spaced apposed walls and forming a foot relief.

9. A base unit, as claimed in claim 1, wherein:

said second pair of spaced opposed walls are a pair of recessed walls.

10. A base unit for mounting a slot machine thereon, said base unit comprising:

a pair of spaced opposed side walls, each spaced opposed side wall including a first opening;

at least one adjacent wall interconnecting said pair of spaced opposed side walls and arranged substantially perpendicular thereto, said pair of spaced opposed side walls and said at least one adjacent wall forming a central opening therebetween; an upper surface attached to said spaced apposed side walls; and a removable upper panel mountable on said upper surface.

11. A base unit, as claimed in claim 10 further including:

at least one pair of flanges away from said at least one adjacent wall.

12. A base unit, as claimed in claim 10, further including:

an access door mounted on said at least one adjacent wall.

13. A base unit, as claimed in claim 10, further including:

a bottom member interconnecting said pair of spaced opposed side walls and said at least one adjacent wall, said bottom member including at least one second opening formed therethrough; and a trap door mounted to said bottom member and covering said second opening.

14. A base unit, as claimed in claim 13, further including:

at least one channel connected to said bottom member for supporting said bottom member above the surface of the ground, said at least one channel being positioned interiorly of said at least one adjacent wall and forming a foot relief.

15. A base unit, as claimed in claim 10, further including:

a divider placed within said central opening for creating at least two modules therein.

16. A base unit, as claimed in claim 10, further including:

at least one removable side panel positionable over one of said first openings of said pair of spaced opposed side walls.

17. A base unit, as claimed in claim 10, wherein:

said at least one adjacent wall is a recessed wall.

18. A base unit, as claimed in claim 17, wherein:

said at least one removable side panel includes a plurality of holes formed therethrough to reduce the weight of said at least one removable side panel.

19. A base unit for mounting a gaming machine thereon, said base unit comprising:

a pair of spaced opposed side walls;

at least one facing wall interconnecting said space apposed side walls and arranged substantially perpendicular thereto, said spaced opposed side walls and said at least one facing wall forming a central opening therebetween;

a bottom member attached to said side walls and said at least one facing wall, said bottom member placed a predetermined height above the floor and forming a foot relief; and a trap door mounted to said bottom member.

20. A base unit for mounting a gaming machine thereon, said base unit comprising:

means for forming a central opening including at least one wall;

an access door mounted to said at least one wall;

a bottom member connected to said forming means; and a trap door mounted to said bottom member.

21. A base unit, as claimed in claim 20, wherein said forming means further includes:

a pair of opposed side walls; and said at least one wall is a recessed wall interconnecting said side walls and arranged substantially perpendicular thereto.

22. A base unit, as claimed in claim 21, wherein said pair of opposed side walls include:

at least one removable panel positionable over one of said pair of opposed side walls.

23. A base unit, as claimed in claim 20, further including:

at least one pair of flanges extending away from said at least one wall.

24. A base unit, as claimed in claim 20, further including:

an upper surface attached to said forming means; and a removable upper panel mountable on said upper surface.

25. A base unit, as claimed in claim 20, further including:

a divider placed within said central opening for creating at least two modules therein.

26. A base unit, as claimed in claim 20, further including:

at least one channel connected to said bottom member for supporting said bottom member above the floor, said at least one channel being positioned interiorly of said at least one wall to form a foot relief.

27. A base unit for mounting a gaming machine thereon, said base unit comprising:

means for forming a central opening including at least one wall;

means for accessing said at least one wall mounted to said at least one wall;

a bottom member connected to said forming means;

an upper surface attached to said forming means; and a removable upper panel mountable on said upper surface.

28. A base unit, as claimed in claim 27, further including:

means connected to said bottom member for accessing the floor under said bottom member.

* * * * *